US005286398A

United States Patent [19]

Krespan

[11] Patent Number: 5,286,398

[45] Date of Patent: Feb. 15, 1994

[54] END-CAPPED POLYALKYLENE OXIDE COMPOSITIONS WITH HYDROXYL GROUP FUNCTIONALITY AND USE THEREOF FOR LUBRICATION IN REFRIGERATION SYSTEMS

[75] Inventor: Carl G. Krespan, Wilmington, Del.

[73] Assignee: E. I. Du Pont de Nemours and Company, Wilmington, Del.

[21] Appl. No.: 835,650

[22] Filed: Feb. 13, 1992

[51] Int. Cl.[5] ..... C09K 5/04

[52] U.S. Cl. ..... 252/68; 252/54; 252/52 A; 568/615

[58] Field of Search ..... 252/54, 52 A, 68; 568/615

[56] References Cited

U.S. PATENT DOCUMENTS

| | | | |
|---|---|---|---|
| 4,129,603 | 12/1978 | Bell | 260/653 |
| 4,158,675 | 6/1979 | Potter | 260/653.7 |
| 4,248,726 | 2/1981 | Uchinuma et al. | 252/52 A |
| 4,267,064 | 5/1981 | Sasaki et al. | 252/52 |
| 4,311,863 | 1/1982 | Gumprecht | 570/170 |
| 4,359,394 | 11/1982 | Gainer et al. | 252/54 |
| 4,755,316 | 7/1988 | Magid | 252/68 |
| 4,900,463 | 2/1990 | Thomas et al. | 252/54 |
| 4,975,212 | 12/1990 | Thomas et al. | 252/54 |
| 5,037,570 | 8/1991 | Gorski et al. | 252/54 |
| 5,053,155 | 10/1991 | Mahler | 252/67 |
| 5,100,569 | 3/1992 | Nalewajek et al. | 252/54 |

FOREIGN PATENT DOCUMENTS

| | | |
|---|---|---|
| 2350513 | 10/1973 | Fed. Rep. of Germany . |
| 2530623 | 7/1982 | France . |
| 9007562 | 7/1990 | PCT Int'l Appl. . |
| 1469960 | 6/1974 | United Kingdom . |
| 1578933 | 4/1978 | United Kingdom . |
| 2030981 | 8/1979 | United Kingdom . |

OTHER PUBLICATIONS

H. H. Kruse et al, "Fundamentals of Lubrication in Refrigeration Systems and Heat Pumps" ASHRAE transactions, vol. 90, 2B (1984).

H. O. Spauschus, "Evaluation of Lubricants for Refrigeration and air-conditioning Compressors" ASHRAE Transactions, vol. 90 2B (1984) Research Disclosure 17463.

L. E. St. Pierre "Polyethers Part I" pp. 135-138 and pp. 147-150 N. G. Gaylord Ed. (Interscience, 1963).

A. S. Kostens "Polyethers Part I" pp. 221-236 N. G. Gaylord Ed (Interscience, 1963).

F. D. Trischler et al. "Preparation of Fluorine-Containing Polyethers" J. J. Polymer Sci. Part A-1, 5, 2343-2349 (1967).

*Primary Examiner*—Paul Lieberman

*Assistant Examiner*—Necholus Ogden

[57] ABSTRACT

Lubricant compositions are disclosed comprising end-capped polyalkylene oxides having viscosities at 100° F. of from 50 to 3000 SUS and the formula $$R^1(OC(R^2)HCH_2)_wO(CH_2C(CH_3)HO)_x(CH_2CH_2O)_y(CH_2C(R^2)HO)_zH,$$

wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms (provided that when $R^1$ is an alkyl group, w is 0) and wherein $R^2$ is selected from the group consisting of perfluoroalkyl groups having from 1 to 4 carbon atoms. The lubricants may be used in combination with refrigerants containing a saturated hydrocarbon having 1 to 4 carbon atoms that is partially or fully substituted with fluorine and/or chlorine and has a normal boiling point of from −80° C. to +50° C. (e.g., $CF_3CH_2F$). Lubrication of compression refrigeration equipment using said refrigerants may be improved using the lubricants described herein.

11 Claims, No Drawings

END-CAPPED POLYALKYLENE OXIDE COMPOSITIONS WITH HYDROXYL GROUP FUNCTIONALITY AND USE THEREOF FOR LUBRICATION IN REFRIGERATION SYSTEMS

FIELD OF THE INVENTION

This invention relates to the lubricants suitable for use with refrigerants in compression refrigeration and air-conditioning systems, and more particularly, it relates to lubricants suitable for use with saturated hydrocarbons having 1–4 carbon atoms such as $CCl_2F_2$, $CF_3CH_2F$, $CHF_2CHF_2$ and $CF_3CHF_2$ that are partially or fully substituted with at least one atom of chlorine or fluorine, and have a normal boiling point of −80° C. to +50° C.

BACKGROUND OF THE INVENTION

Refrigeration systems that use dichlorodifluoromethane (i.e., CFC-12) as the refrigerant generally use mineral oils to lubricate the compressor. (See for example the discussion in Chapter 32 of the 1980 ASHRAE Systems Handbook.) CFC-12 is completely miscible with such oils throughout the entire range of refrigeration system temperatures, i.e., −45° C. to 65° C. In automotive air-conditioning, paraffinic and naphthenic oils of about 500 SUS viscosity at 100° F. are usually used with CFC−12. These oils have "pour points" below −20° C. and viscosities of about 55 SUS at 210° F. and are completely miscible with the CFC-12 refrigerant over the range of temperatures from −10° C. to 100° C. Consequently, oil which dissolves in the refrigerant travels through the refrigeration loop in the air conditioning system and returns with the refrigerant to the compressor. It does not separate during condensation, although it may accumulate because of the low temperature when the refrigerant is evaporated. At the same time, this oil which lubricates the compressor will contain some refrigerant which, in turn, may affect its lubricating properties.

If lubricant separates from refrigerant during operation of the system, serious problems may result, i.e., the compressor could be inadequately lubricated. This would be most serious in automotive air-conditioning systems because the compressors are not separately lubricated and a mixture of refrigerant and lubricant circulate throughout the entire system. Two publications of ASHRAE Transactions, Vol. 90, 2B (1984) discuss the problems associated with separation of lubricants and refrigerants. These are H. H. Kruse et al., "Fundamentals of Lubrication in Refrigerating Systems and Heat Pumps" at pages 763–782, and H. O. Spauschus, "Evaluation of Lubricants for Refrigeration and Air-Conditioning Compressors" at pages 784–798.

Refrigerants which are not completely miscible with an oil in the full range of mixture compositions and operating temperatures may become miscible or immiscible as the temperature is raised or lowered from room temperature. The areas of immiscibility may assume a variety of shapes, i.e., parabolic or non-parabolic. As a parabola, the curve of miscibility temperature vs. percent oil in the mixture, may have its open or concave portion facing the low or high temperatures. The closed or convex portion of the parabolic curve identifies, respectively, the maximum or minimum temperature above or below which the refrigerant and the lubricating oil are completely miscible. These temperatures are referred to as the maximum or minimum "consolute temperatures." Beside parabolas, these curves can assume skewed parabolic shapes or curves of varying slope wherein immiscibility occurs above or below the curve.

The compounds 1,1,1,2-tetrafluoroethane (i.e., HFC-134a), and 1,1,2,2-tetrafluoroethane (i.e., HFC-134), etc. and to a lesser extent, pentafluoroethane (i.e., HFC-125) are being considered as replacements for dichlorodifluoromethane (CFC-12), particularly in automotive air conditioning systems. When substituting a compound such as HFC-134a or HFC-134, or mixtures thereof for CFC-12 in these refrigeration systems, it would be desirable to be able to use the same oils as used with CFC-12. It would not require any substantial change in equipment nor any significant changes in conditions used for the system. Unfortunately, the mineral oils are substantially immiscible with the tetrafluoroethanes.

Lubricants employing polyoxyalkylene glycols have been considered for use with CFC-12 and its replacements. These lubricants may be classified on the basis of their functionality with respect to hydroxyl groups. U.S. Pat. No. 4,755,316, issued Jul. 5, 1988, to Allied-Signal Inc. relates to the use of polyoxyalkylene glycols which are at least difunctional with respect to hydroxyl groups. Research Disclosure 17463 entitled "Refrigeration Oil" by E. I. du Pont de Nemours and Company discloses polyalkylene glycols such as Ucon® LB-165 and Ucon® LB-525 sold by Union Carbide Corporation, for use with HFC-134a. These glycols are polyoxypropylene glycols that are monofunctional. Research Disclosure 17463 indicates that the combinations of oil and refrigerant are considered miscible in all proportions at temperatures at least as low as −50° C. and are thermally stable in the presence of steel, copper and aluminum at 175° C. for about six days. However, U.S. Pat. No. 4,755,316, indicates at column 5, lines 14–19 that Ucon® LB-525 has been found to be immiscible at above about +5° C. with HFC-134a, and that, practically, this means that such lubricants are not miscible with HFC-134a over most of the temperature range used in automotive air conditioning (generally from −40° C. to at least +50° C. or higher, and above 90° C., if possible). U.S. Pat. No. 5,053,155 discusses the use of compositions comprising lubricants containing certain monofunctional or certain difunctional materials.

U.S. Pat. No. 4,975,212 relates to certain novel lubricating compositions comprising a polyoxyalkylene glycol having a cap of a fluorinated alkyl group on at least one end thereof. However, hydroxyl group functionality of the polyoxyalkylene glycol is reduced by such capping.

SUMMARY OF THE INVENTION

The present invention employs a polyoxyalkylene glycol having a cap on at least one end thereof which has both a perfluoroalkyl group and a hydroxyl group. More particularly, a lubricating composition is provided in accordance with this invention which comprises at least one 2-hydroxy-2-perfluoroalkylethyl end capped polyalkylene oxide having a viscosity at 100° F. of from 50 to 3000 SUS and the formula $$R^1(OC(R^2)HCH_2)_wO(CH_2C(CH_3)HO)_x(CH_2CH_2O)_y(CH_2C(R^2)HO)_zH$$

wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms (provided that when $R^1$ is an alkyl group, w is 0) and wherein $R^2$ is selected from the group consisting of perfluoroalkyl groups having from 1 to 4 carbon atoms. This invention also provides a composition for use in compression refrigeration which comprises (a) a refrigerant containing a saturated hydrocarbon having from 1 to 4 carbon atoms that is partially or fully substituted with fluorine and/or chlorine and has a normal boiling point of from −80° C. to +50° C. (e.g., $CCl_2F_2$, $CF_3CH_2F$, $CHF_2CHF_2$ and/or $CF_3CHF_2$) along with (b) at least one of said 2-hydroxy-2-perfluoro-alkylethyl end capped polyalkylene oxides. This invention further provides a method of improving lubrication in compression refrigeration equipment using said refrigerant (a) which comprises the step of employing a lubricant containing at least one of said 2-hydroxy-2-perfluoroalkylethyl end capped polyalkylene oxides.

DETAILED DESCRIPTION

The present invention involves lubricants which comprise at least one 2-hydroxy-2-perfluoroalkylethyl end capped polyalkylene oxide compound having the formula:

$$R^1(OC(R^2)HCH_2)_wO(CH_2C(CH_3)HO)_x(CH_2CH_2O)_y(CH_2C(R^2)HO)_zH$$

wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms, provided that when $R^1$ is an alkyl group, w is 0, and where $R^2$ is selected from the group consisting of perfluoroalkyl groups having from 1 to 4 carbon atoms. As is evident from the formula above, the 2-hydroxy-2-perfluoroalkylethyl end cap provides hydroxyl group functionality. Preferably, $R^1$ is alkyl. Lubricants of this type are not only completely miscible over the full operating temperature range for automotive air-conditioning with HFC-134a and the like, but are also completely miscible with CFC-12 over this range. Hence, they may be used with CFC-12 in the same systems during the transition from CFC-12 to HFC-134a. The preferred 2-hydroxy-2-perfluoroalkylethyl end capped polyalkylene oxide oils of this invention include those of the above formula wherein y is 0 and z is from 2 to 10; and those of said formula wherein y is from 1 to 20.

Lubricants of this type may be employed in accordance with this invention in a method for improving lubrication in compression refrigeration equipment using a refrigerant containing a saturated hydrocarbon having from 1 to 4 carbon atoms that is partially or fully substituted with fluorine, chlorine or both fluorine and chlorine and has a normal boiling point of from −80° C. to +50° C. Indeed lubricants comprising said 2-hydroxy-2perfluoroalkylethyl end capped polyalkylene oxide(s) and having an SUS viscosity at 100° F. of at least 50 (and preferably having a pour point of about −10° C., or less) may be used in combination with a refrigerant comprising at least one compound selected from the group consisting of HFC-134, HFC-134a, HFC-125, CFC-12, and any other saturated hydrocarbon having from 1 to 4 carbon atoms that is partially or fully substituted with at least one atom of chlorine or fluorine and has a normal boiling point of from −80° C. to +50° C., to provide a composition for use in compression refrigeration.

The weight ratio of refrigerant to the 2-hydroxy-2-perfluoroalkylethyl end capped polyalkylene oxide, is preferably from 99:1 to 1:99, and is more preferably from 99:1 to 70:30.

It is known that the use of an appropriate amount of an "extreme pressure (EP) additive" improves the lubricity and load-bearing characteristics of oils and, thus, would improve the quality of the refrigerant-lubricant compositions. EP additives for use in the invention are included among those disclosed in Table D of U.S. Pat. No. 4,755,316. A preferred one is an organic phosphate; SYN-O-AD® 8478, a 70%/30% blend of tri (2,4,6-tri-t-butyl phenyl) phosphate/triphenyl phosphate, manufactured by the Akzo company.

EP additives may also be used in conjunction with various of the antiwear additives, oxidation and thermal stability improvers, corrosion inhibitors, viscosity index improvers, detergents and anti-foaming agents disclosed in Table D of U.S. Pat. No. 4,755,316. These additives may also be partially or fully fluorinated.

Preferred refrigerants contain at least 10 percent by weight of a compound selected from HFC-134a, HCF-134 and HCF-125. As noted above, these compounds, particularly HFC-134a, have physical characteristics which allow substitution for CFC-12 with only a minimum of equipment changes in compression refrigeration. They could be blended with each other, as well as with other refrigerants, including CFC-12 ($CCl_2F_2$), HCFC-22 ($CHClF_2$), HFC-152a ($CH_3CHF_2$), HCFC-124 ($CHClFCF_3$), HCFC-124a ($CHF_2CClF_2$), HCFC-142b ($CH_3CClF_2$), HFC-32 ($CH_2F_2$), HFC-143a ($CH_3CF_3$), HFC-143 ($CHF_2CH_2F$), and FC-218 ($CF_3CF_2CF_3$); and for purposes of the present invention such blends are not excluded. Those blends of tetrafluoroethane or pentafluoroethane with other refrigerants which are miscible with lubricants of this invention in the range of −40° C. to at least about +20° C. are preferred.

HFC-134a, the preferred tetrafluoroethane refrigerant, may be prepared by any of the methods disclosed in the prior art; e.g., U.S. Pat. No. 4,129,603; U.S. Pat. No. 4,158,675; U.S. Pat. No. 4,311,863; U.S. Pat. No. 4,792,643; British Patent Specification 1,578,933 and British Patent Specification 2,030,981.

The preferred fluorine-containing polyethers are prepared by treatment of a preformed polyalkylene oxide having at least one hydroxyl end group per chain with a stoichiometric amount of a strong base such as potassium tert-butoxide or sodium hydride to form the metal alkoxide derivative of the polymer, followed by treatment of this alkoxide with the calculated amount of perfluoroalkyloxirane. The reactions are exothermic and can most conveniently be carried out at 25° to 50° C. Reaction time should be sufficient to allow dissipation of the exotherm, and may be from 15 min. to 24 hr., depending upon the amounts involved. Any polar solvent which does not interfere with alkoxide formation is suitable, e.g., tert-butanol, tetrahydrofuran, diglyme, dimethyl sulfoxide and N-methylpyrollidone. Acidification of the reaction mixture allows isolation of the polymeric product after removal of volatiles under vacuum or by extraction with water. A final purification of the product oil is desirable as a means of insuring optimum stability and is most readily accomplished by treatment with alumina.

Another method for the preparation of fluorine-containing polyethers involves a base-catalyzed block polymerization in which the propylene oxide-derived segment is prepared first and one or more units of fluoroalkyloxirane are then added to create the fluorine-containing end unit or block.

Base-catalyzed polymerization of propylene oxide to form either homopolymer or copolymer with ethylene oxide is well known in the art. L. E. St. Pierre in "Polyethers Part I," N. G. Gaylord, Ed. (Interscience Publishers, New York, 1963) discusses the mechanism of base-catalyzed polymerization of propylene oxide (p. 135 et seq.) and copolymerization of propylene oxide with ethylene oxide (p. 147 et seq.). In the same volume, A. S. Kastens details the properties of commercial polyalkylene oxides derived from propylene oxide (p. 221 et seq.). Polymerizations initiated by an alkoxide ion derived from a monohydric alcohol lead to polyalkylene glycols containing one hydroxyl group per chain. Initiation with hydroxide ion or with an alkoxide derived from a glycol produces polyether with two hydroxyl end groups. Such polyethers may be derivatized selectively by addition of a single fluoroalkylated epoxide to each hydroxyl end, or, alternatively, by addition of poly(fluoroalkyloxirane) blocks to each hydroxyl end. Polymerization of trifluoromethyl oxirane with basic catalysts is disclosed by Trischler, F. D. and Hollander, J. J. Polymer Sci.Part A-1, 5, 2343 (1967).

The 2-hydroxy-2-perfluoroalkylethyl end capped polyalkylene oxides may be varied to yield viscosities ranging from 50 to 3000 SUS at 100° F. They may be blended with each other and with other lubricants, e.g. perfluorocarbons, other hydrofluorocarbons, naphthenic, paraffinic, alkylbenzenes, polyalkylbenzenes, etc., to modify viscosity and/or lubrication properties. The lubricants of this invention preferably contain at least about 4 percent by weight of said 2-hydroxy-2-perfluoroalkyl-ethyl end capped polyalkylene oxide(s); more preferably at least about 8 percent by weight of said 2-hydroxy-2-per-fluoroalkylethyl end capped polyalkylene oxide(s).

Lubricants of the type used to provide lubrication in compression refrigeration and air-conditioning equipment have various characteristics which are considered for such applications. Viscosity is one such characteristic. Other characteristics which might be considered include, pour point, solubility or miscibility and/or stability.

Viscosity is a property that defines a fluid's resistance to shearing force. It is expressed in terms of absolute viscosity, kinematic viscosity or Saybolt Seconds Universal viscosity (SSU), depending on the method by which it is determined. Conversion from SSU to $mm^2/s$ (centistokes) can be readily made from tables contained in ASTM D-445, but it is necessary to know the density to convert kinematic viscosity to absolute viscosity. Refrigeration oils are sold in viscosity grades, and ASTM has proposed a system of standardized viscosity grades for industry-wide usage (D-2422).

Viscosity decreases as the temperature increases; and increases as the temperature decreases. The relationship between temperature and kinematic viscosity is represented by:

$$\log \log(v+0.7)=A+B \log T,$$

where v is the kinematic viscosity in $mm^2/s$ (CST), T is the thermodynamic temperature (kelvin) and A and B are constants for each oil. This relationship is the basis for the viscosity temperature charts published by ASTM and permits a straight line plot of viscosity over a wide temperature range. This plot is applicable over the temperature range in which the oils are homogeneous liquids. Viscosity Index is a measure of the amount of change in viscosity experienced by an oil with change in temperature. It is determined in accordance with the ASTM method described in D2270-79.

The lubricants employed in this invention should have a viscosity at 100° F. of from 50 to 3000 SUS. For embodiments used for most commercial purposes, the viscosity at 100° F. preferably ranges from 100 to 1200 SUS. Lubricants having a viscosity at 100° F. of about 500 SUS are considered particularly suitable for automotive air-conditioning.

Any oil intended for low temperature service should be able to flow at the lowest temperature likely to be encountered. Pour point is an indication of this flow characteristic. The procedure for determining pour point is described in ASTM D-97-66. Preferably the lubricants employed in this invention have a pour point of −10° C. or less. Pour points below −15° C. are especially preferred for the 100 SUS and 1200 SUS oils.

Preferably, the lubricant and the refrigerant will be completely miscible in one another in the range of temperatures from −5° C. or less to at least about 20° C. In accordance with this invention an amount of one or more of said 2-hydroxy-2-perfluoroalkylethyl end capped polyalkylene oxides effective to lubricate (usually 10 to 20 percent by weight for automotive and in some situations as high as 50 percent by weight) is completely miscible with one or more of said saturated halogen-substituted hydrocarbons (usually 80 to 90 percent by weight). For applications involving relatively low temperatures, combinations which are completely miscible to −10° C. or less are more preferred, and combinations which are completely miscible to −40° C., or less are especially preferred. For applications involving relatively high temperatures, combinations which are completely miscible to 50° C. are more preferred and combinations which are completely miscible to 100° C., the critical temperature of HFC-134a or more, are especially preferred. Combinations which are completely miscible over the range of −40° C. to 100° C. are thus particularly versitile. Indeed, in some preferred embodiments the lubricants used in this invention have a solubility or miscibility range of 100% from 100° C. to less than −40° C. for from 1 to 99 weight percent of HFC-134a in mixture with the lubricant of 100° F. viscosities of 50 SUS to 3000 SUS.

Stability is also a consideration in choosing a lubricant. A lubricant preferably demonstrates oxidative stability for storage and handling, thermal stability to withstand polymerization and/or decomposition under process temperatures, and chemical stability to resist reaction with refrigerant and materials of construction. Indicators of relative stabilty include viscosity and appearance changes.

The invention will be more clearly understood by referring to the non-limiting examples which follow.

EXAMPLES

Example 1

Preparation of

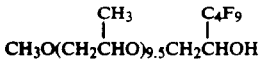

A heavy-walled tube was charged under nitrogen with 2.7 g (0.05 mol) of anhydrous sodium methoxide, 50 mL of tetrahydrofuran, and 29.0 g (0.50 mol) of propylene oxide, and then heated at 85°-90° C. for two days. Analysis by GC showed the propylene oxide had been consumed. The cooled reaction mass was treated with 13.1 g (0.050 mol) of F-(butyl)oxirane and stirred overnight while a mild exotherm dissipated. Acetic acid (5.0 g, 0.08 mol) was added, the mixture was stirred well, and volatiles were removed by warming the mixture to 40° C. at 0.1 mm. Analysis of the low boilers by GC indicated the presence of 1.6 g (12%) of recovered F-(butyl)oxirane.

The residual "block" copolymer was extracted with 3×100 mL of water then dried at 50° C. (0.1 mm) to afford 30.0 g of light-colored oil. Filtration to remove cloudiness gave 28.9 g (70% yield) of oil, viscosity about SUS 304. IR analysis confirmed the presence of hydroxy end group and the virtual absence of unsaturation. The elemental analysis (C, H, F) corresponded to a composition of about 9.5 propylene oxide/1 F-(butyl-)oxirane.

Example 2

Preparation of

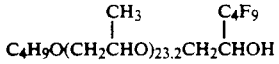

A mixture of 300 mL of tert-butanol, 5.4 g (0.048 mol) of potassium tert-butoxide, and 142.0 g (0.10 mol) of Union Carbide LB525 oil (a monofunctional polyoxypropylene glycol) was stirred under nitrogen until it was homogeneous. Then 13.1 g (0.050 mol) of F-(butyl-)oxirane was added, and the mixture was stirred for one day. Addition of 3.8 g (0.063 mol) of acetic acid, mixing, and removal of volatiles under vacuum gave a residue which was extracted with 2×500 mL of water. The oily layer was then dried at 75° C. (0.3 mm), filtered, and dissolved in 400 mL of ether. The ether solution was washed with water, dried over $CaSO_4$, and filtered. Volatiles were removed by heating to 70° C. (3 mm) to afford 141.3 g of clear yellow oil, viscosity about SUS 618. Analysis for C, H, F indicated that about ½ of the LB525 molecules had been capped with F-(butyl)oxirane, as desired, to give a product containing F at the 5% level.

Example 3

Preparation of

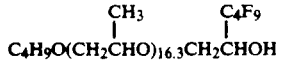

A mixture of 300 mL of tert-butanol, 5.4 g (0.048 mol) of potassium tert-butoxide, and 51.0 g (0.050 mol) of Union Carbide LB285 (a monofunctional polyoxypropylene glycol) was stirred under nitrogen until homogeneous. Then 13.1 g (0.050 mol) of F-(butyl)oxirane was added, and the mixture was stirred for one day. Acidification with acetic acid and removal of volatiles under vacuum gave a residue which was dissolved in ether, washed twice with water, dried over $CaSO_4$, filtered, and evaporated to residual oil at 60° C. (0.4 mm). The product, 60.0 g of orange oil, viscosity about SUS 439, was shown by analysis to contain about 12% F.

Example 4

Preparation of

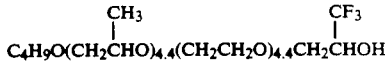

A homogeneous mixture of 300 mL of tert-butanol, 10.1 g (0.09 mol) of potassium tert-butoxide, and 52.0 9 (0.10 mol) of Union Carbide 50 HB100 oil (a 50/50 mol % polyoxyethylene glycol/polyoxypropylene glycol) was treated with 11.2 g (0.10 mol) of trifluoromethyloxirane. The mixture was stirred for one day, acidified with acetic acid, and heated at 50° C. (0.25 mm) to remove volatiles. The crude oil was placed on a column of 750 g of basic alumina, developed with 500 mL of ether, then eluted with 9:1 ether/methanol mixture. Evaporation of the eluates finishing at 60° C. (0.1 mm) gave 53.4 9 (84%) of yellowish oil, viscosity about SUS 120, containing 7% F by analysis.

Example 5

Preparation of

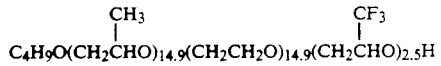

A homogeneous mixture of 150 mL of tert-butanol, 5.05 g of potassium tert-butoxide, and 79.5 9 (0.050 mol) of Union Carbide 50HB660 (a 50/50 mol % polyoxyethylene glycol/polyoxypropylene glycol) was stirred with 16.8 g (0.15 mol) of trifluoromethyloxirane for two hours while the temperature carried to 43° C., then fell. Neutralization of the mixture with acetic acid, removal of volatiles under reduced pressure, and chromatographic purification on basic alumina gave, after removal of solvents, 84.8 g (88%) of light yellow oil, viscosity about SUS 779. Analysis showed about 7.2% F for 2.5 trifluoromethyloxirane units per chain.

Example 6

Preparation of

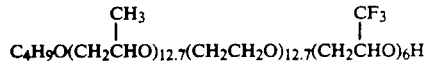

A homogeneous mixture of 92 mL of tert-butanol, 3.0 g (0.027 mol) of potassium tert-butoxide, and 41.0 g (0.030 mol) of Union Carbide 50HB500 (a 50/50 mol % polyoxyethylene glycol/polyoxypropylene glycol) was stirred with 20.1 g (0.179 mol) of trifluoromethyloxirane with cooling to bring the temperature below 35° C. After 1.5 hr., the reaction was worked up as above to afford 55.7 g (91%) of viscous, pale yellow oil, viscosity about SUS 802. Analysis indicated 17.7% F, or 6 trifluoromethyloxirane units per chain.

Example 7

Six mL blends of refrigerant and the lubricant oils obtained in Examples 1 through 6 were used for the solubility runs for mixtures which contained 30, 60 and 90 weight percent of HFC-134a. These air-free mixtures were contained in sealed Pyrex® tubes (7/16"I.D.×5.5", ca. 12.5 mL capacity). The refrigerant/lubricant solubilities were determined by completely immersing the tube in a bath at each test temperature for a minimum of 15 minutes and providing agitation to facilitate mixing and equilibration. The accuracy of determining the temperatures when the refrigerant/lubricant blend became either miscible or immiscible was about ±2° C. The refrigerant/lubricant blends were called immiscible when the blend acquired and retained "schlieren" lines; formed floc; became cloudy or formed two liquid layers. These solubility tests were run from 93° to below zero, normally −50° C. While tests were not run above 93° C. for safety reasons if the blends of HFC-134a/oil which were soluble at 93° C., are considered likely to be soluble at 100° C., the critical temperature of HFC-134a. The results of the runs are summarized in Table I below.

TABLE I

Solubility of HFC-134a in Various Mixtures with 2-Hydroxy-2-Perfluoroalkylethyl End Capped Polyalkylene Oxides as a Function of Temperature

| Run No. | Oil | Wt. % HFC in HFC/oil | Temperature Range (°C. to °C.) Soluble | Schlieren Lines | Hazy | 2-liquid Phases |
|---|---|---|---|---|---|---|
| 1 | Ex. 1 | 30 | 43 to −22 | −22 to −50 | — | 93 to 43 |
| 2 | Ex. 1 | 60 | 43 to −42 | −42 to −50 | — | 93 to 43 |
| 3 | Ex. 1 | 90 | 78 to −50 | — | 82 to 78 | 93 to 82 |
| 4 | Ex. 2 | 30 | 90 to −5 | 93 to 90 | — | — |
| 5 | Ex. 2 | 60 | 68 to −35 | −5 to −50 | — | 93 to 68 |
| 6 | Ex. 2 | 90 | 20 to −40 | −35 to −50 | 93 to 20[a] | −40 to −50 |
| 7 | Ex. 3 | 30 | 73 to −25 | 93 to 73 | — | — |
| 8 | Ex. 3 | 90 | 78 to −50 | 88 to 73 | — | 93 to 88 |
| 9 | Ex. 3 | 90 | 78 to −50 | — | — | 93 to 78 |
| 10 | Ex. 4 | 30 | 93 to −50 | — | — | — |
| 11 | Ex. 4 | 60 | 40 to −50 | — | — | 93 to 40 |
| 12 | Ex. 4 | 90 | 80 to −50 | — | — | 93 to 80 |
| 13 | Ex. 5 | 30 | 40 to −50 | — | — | 93 to 40 |
| 14 | Ex. 5 | 60 | 40 to −50 | — | — | 93 to 40 |
| 15 | Ex. 5 | 90 | 40 to −50 | — | — | 93 to 40 |
| 16 | Ex. 6 | 30 | — | — | 93 to −20 | −20 to −50 |
| 17 | Ex. 6 | 60 | — | — | 55 to −20 | 93 to 55 |
| 18 | Ex. 6 | 90 | 20 to −35 | — | 50 to 20 | 93 to 50 |

[a]Mixture was cloudy.

Example 8

Three mL of lubricant alone from Examples 1 through 6, or 1.5 mL each of refrigerant and lubricant, plus coupons (steel 1010/ copper/aluminum 1100−2⅜"×¼"×1/16", 120-grit surface finish) were charged and sealed in a Pyrex® tube (7/16" I.D.×5.5", ca. 12.5 mL volume) under anaerobic conditions. The specimens were tied together at the top end with copper wire and with copper-wire rings-between the metals to separate the metals at the top end. The tubes were stored vertically at either 77° F. or 400° F. for 11.8 days. Afterwards, the contents of the tubes stored at 400° F. were examined for appearance changes. These changes were assigned effect ratings: O—no change; 1—slight acceptable change; 2—borderline change; 3—slight unacceptable change; 4—moderate unacceptable change; and 5—substantial unacceptable change. The oil was removed from the tube to determine if the lubricant degraded by measuring its viscosity at 100° F.

The results are summarized in Table II below. It is noted that the products of Examples 1 through 3 (see runs 19 through 27) were not purified by treatment with alumina prior to testing.

The examples serve to illustrate particular embodiments of the invention. Other embodiments will become apparent to those skilled in the art from a consideration of the specification or practice of the invention disclosed herein. It is understood that modifications and variations may be practiced without departing from the spirit and scope of the novel concepts of this invention. It is further understood that the invention is not confined to the particular formulations and examples herein illustrated, but it embraces such modified forms thereof as come within the scope of the claims.

TABLE II

Stability of HFC-134a/Oil Mixture in Contact with Steel-1010 (Fe), Copper (Cu), and Aluminum-1100 (Al) at 400° C. for 11.8 Days

| Run | 134a/oil | Temp | 100° F. Oil Visc. | Appearance Rating | | | |
|---|---|---|---|---|---|---|---|
| No. | Oil | (cc/cc) | °F. | (SUS) | Liq. | Fe | Cu | Al |
| 19 | Ex. 1 | 0/3 | 77 | 304 | — | — | — | — |
| 20 | Ex. 1 | 0/3 | 400 | 90 | 4[a] | 1[d] | 0 | 1[d] |
| 21 | Ex. 1 | 1.5/1.5 | 400 | 125 | 3[b] | 2[e] | 0 | 2[f] |
| 22 | Ex. 2 | 0/3 | 77 | 618 | — | — | — | — |
| 23 | Ex. 2 | 0/3 | 400 | 612 | 0 | 0 | 0 | 0 |
| 24 | Ex. 2 | 1.5/1.5 | 400 | 568 | 0 | 0 | 0 | 0 |
| 25 | Ex. 3 | 0/3 | 77 | 439 | — | — | — | — |
| 26 | Ex. 3 | 0/3 | 400 | 288 | 5[c] | 2[f] | 0 | 2[h] |
| 27 | Ex. 3 | 1.5/1.5 | 400 | 288 | 3[b] | 0 | 0 | 0 |
| 28 | Ex. 4 | 0/3 | 77 | 120 | — | — | — | — |
| 29 | Ex. 4 | 0/3 | 400 | 119 | 0 | 0 | 0 | 0 |
| 30 | Ex. 4 | 1.5/1.5 | 400 | 110 | 0 | 0 | 0 | 0 |
| 31 | Ex. 5 | 0/3 | 77 | 748 | — | — | — | — |
| 32 | Ex. 5 | 0/3 | 400 | 745 | 0 | 0 | 0 | 0 |
| 33 | Ex. 5 | 1.5/1.5 | 400 | 700 | 0 | 1[g] | 0 | 0 |
| 34 | Ex. 6 | 0/3 | 77 | 726 | — | — | — | — |
| 35 | Ex. 6 | 0/3 | 400 | 671 | 0 | 0 | 0 | 0 |

TABLE II-continued

Stability of HFC-134a/Oil Mixture in Contact with Steel-1010 (Fe), Copper (Cu), and Aluminum-1100 (Al) at 400° C. for 11.8 Days

| Run No. | Oil | 134a/oil (cc/cc) | Temp °F. | 100° F. Oil Visc. (SUS) | Appearance Rating Liq. | Fe | Cu | Al |
|---|---|---|---|---|---|---|---|---|
| 36 | Ex. 6 | 1.5/1.5 | 400 | 530 | 0 | 0 | 0 | 0 |

[a]Black, opaque
[b]Clear, dark amber
[c]Brown, solid
[d]Dull, 100%
[e]Clear film, liquid phase
[f]Clear film, 100%
[g]Black tarnish, 50%, vapor phase
[h]Gray film, 100%

What is claimed is:

1. A lubricating composition comprising: at least one 2-hydroxy-2-perfluoroalkylethyl end capped polyalkylene oxide prepared by capping a preformed polyalkylene oxide, said end-capped polyalkylene oxide having a viscosity at 100° C. of from 50 to 3000 SUS and the formula $$R^1(OC(R^2)HCH_2)_wO(CH_2C(CH_3)HO)_x(CH_2CH_2O)_y(CH_2C(R^2)HO)_zH$$

wherein at least one of the terminal groups contains one perfluoroalkyl group and one hydroxyl group attached to the same carbon wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms, provided that when $R^1$ is an alkyl group, w is 0, and wherein $R^2$ is selected form the group consisting of perfluoroalkyl groups having from 1 to 4 carbon atoms.

2. The lubricating composition of claim 1 wherein $R^1$ is an alkyl group.

3. The lubricating composition of claim 2 wherein y is 0 and z is from 2 to 10.

4. The lubricating composition of claim 2 wherein y is from 1 to 20.

5. A composition for use in compression refrigeration comprising:

(a) a refrigerant containing a saturated hydrocarbon having 1 to 4 carbon atoms that is partially or fully substituted with fluorine, chlorine or both fluorine and chlorine, and has a normal boiling point of from −80° C. to +50° C.; and (b) a lubricant containing at least one 2-hydroxy-2-perfluoroalkylethyl end capped polyalkylene oxide prepared by capping a preformed polyalkylene oxide, said end-capped polyalkylene oxide having the formula $$R^1(OC(R^2)HCH_2)_wO(CH_2C(CH_3)HO)_x(CH_2CH_2O)_y(CH_2C(R^2)HO)_zH$$

wherein at least one of the terminal groups contains one perfluoroalkyl group and one hydroxyl group attached to the same carbon wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms, provided that when $R^1$ is an alkyl group, w is 0, and wherein $R^2$ is selected from the group consisting of perfluoroalkyl groups having from 1 to 4 carbon atoms, and having a viscosity at 100° F. of from 50 to 3000 SUS.

6. The composition of claim 5 wherein the lubricant and refrigerant are completely miscible in the range of temperatures from −40° C. to at least about 20° C.

7. The composition of claim 5 wherein the refrigerant contains at least 10 percent by volume of a compound selected from $CCl_2F_2$, $CF_3CH_2F$, $CHF_2CHF_2$ and $CF_3CHF_2$.

8. The composition of claim 5 wherein the refrigerant contains at least 10 percent by volume $CF_3CH_2F$.

9. The composition of claim 5 containing from 10 to 50 percent by weight of said 2-hydroxy-2-perfluoroalkylethyl end capped polyalkylene oxides.

10. The composition of claim 5, claim 6, claim 7, claim 8, or claim 9 containing from 10 to 20 percent by weight of said 2-hydroxy-2-perfluoro-alkylethyl end capped polyalkylene oxides and from 80 to 90 percent by weight of said halogen-substituted hydrocarbons.

11. A method of improving lubrication in compression refrigeration equipment using a refrigerant containing a saturated hydrocarbon having from 1 to 4 carbon atoms that is partially or fully substituted with fluorine, chlorine or both fluorine and chlorine and has a normal boiling point of from −80° C. to 50° C., comprising the step of: employing a lubricant containing at least one 2-hydroxy-2-perfluoroalkylethyl end capped polyalkylene oxide prepared by capping a preformed polyalkylene oxide, said end-capped polyalkylene oxide having the formula $$R^1(OC(R^2)HCH_2)_wO(CH_2C(CH_3)HO)_x(CH_2CH_2O)_y(CH_2C(R^2)HO)_zH$$

wherein at least one of the terminal groups contains one perfluoroalkyl group and one hydroxyl group attached to the same carbon wherein w is a number from 0 to 10, x is a number from 4 to 30, y is a number from 0 to 20, and z is a number from 1 to 10, wherein $R^1$ is selected from the group consisting of hydrogen and alkyl groups having from 1 to 8 carbon atoms, provided that when $R^1$ is an alkyl group, w is 0, and wherein $R^2$ is selected from the group consisting of perfluoroalkyl groups having from 1 to 4 carbon atoms, and having a viscosity at 100° F. of from 50 to 3000 SUS.

* * * * *